United States Patent [19]

Minami et al.

[11] Patent Number: 4,896,551

[45] **Date of Patent: * Jan. 30, 1990**

[54] STARTER MOTOR AND PROCESS OF FORMING PINION SHAFT USED IN THE STARTER MOTOR

[75] Inventors: Hideyuki Minami, Kiryu; Tomoo Matsumura, Ohmama; Takashi Yokozuka, Tanuma; Katsuo Takahara, Ohta; Shigeru Okajima, Isesaki, all of Japan

[73] Assignee: Mitsuba Electric Manufacturing Co., Ltd., Gunma, Japan

[ * ] Notice: The portion of the term of this patent subsequent to Jan. 30, 2007 has been disclaimed.

[21] Appl. No.: 166,885

[22] Filed: Mar. 11, 1988

[30] Foreign Application Priority Data

| | | | |
|---|---|---|---|
| Apr. 15, 1987 | [JP] | Japan | 62-92793 |
| Apr. 15, 1987 | [JP] | Japan | 62-57078 |
| Apr. 15, 1987 | [JP] | Japan | 62-57079 |
| May 8, 1987 | [JP] | Japan | 62-111887 |

[51] Int. Cl.[4] ..... F02N 15/02

[52] U.S. Cl. ..... 74/6; 74/7 E; 74/674; 74/768

[58] Field of Search ..... 74/6, 7 E, 665 GA, 665 S, 74/665 K, 674, 768

[56] References Cited

U.S. PATENT DOCUMENTS

| | | | |
|---|---|---|---|
| 1,891,868 | 12/1932 | Ceablom | 74/7 |
| 2,900,848 | 8/1959 | Henn-Collins | 74/768 |
| 2,946,326 | 7/1960 | Batos et al. | 74/6 |
| 3,100,405 | 8/1963 | Brass | 74/665 K |
| 4,161,126 | 7/1979 | Winzeler | 74/674 |
| 4,251,987 | 2/1981 | Adamson | 74/665 S |

FOREIGN PATENT DOCUMENTS

| | | | |
|---|---|---|---|
| 1108675 | 1/1956 | France | 74/768 |
| 1062459 | 12/1983 | U.S.S.R. | 74/674 |

*Primary Examiner*—Rodney H. Bonck
*Assistant Examiner*—Scott Anchell
*Attorney, Agent, or Firm*—Rodman & Rodman

[57] ABSTRACT

The starter motor includes a first output shaft with a pinion gear in mesh with a ring gear of an engine. A first reduction mechanism outputs power from a motor shaft through the first output shaft. A second output shaft and a second reduction mechanism output power from the first output shaft through the second output shaft. The second output shaft is rotatably coupled onto the first output shaft and made coaxial therewith. Power can be taken out on the side of the pinion gear. Both output shafts are associated with each other through a stop member for regulating relative displacement in the axial directions, so that thrusts in directions opposite to the above directions different from each other, which have not been borne, can be borne by each of the output shafts on the other side, respectively. The second reduction mechanism has a plurality of planetary gears orbitally revolving around a sun gear, a stopper for locking against fall-off of the planetary gears from pin shafts is formed on the side of the outer periphery of the planetary gears, being clamped between the ring gear and a case bracket. An annular seal ring partitions the first and second reduction mechanisms. The second output shaft at one end is formed from a cylindrical slug into a pinion shaft with a large diameter flanged portion.

7 Claims, 5 Drawing Sheets

STARTER MOTOR AND PROCESS OF FORMING PINION SHAFT USED IN THE STARTER MOTOR

BACKGROUND OF THE INVENTION

1. Field of the Invention

This invention relates to a starter motor, more particularly to a starter motor usable as a power source for other than engine start.

2. Related Art Statement

A starter motor for carrying out the engine start has heretofore been provided for the specialized functional purpose. Accordingly, the starter motor has been useless except when it is engaged in the engine start, because it is totally out of operation at other times. As shown in Japanese Patent Laid-Open No. 56-6065 or Japanese Utility Model Laid-Open No. 56-165988 for example, power to the outside is taken out from a transmission system of the starter motor.

However, these starter motors are each constructed such that the engine start is carried out at one side of the output shaft and the power is taken out to the outside at the other side of the output shaft, thereby presenting such a disadvantage that the provision of seal construction between the output shaft and a case is necessary at two positions thus increasing the possibility of seal failure.

Then, when two outputs including an output for the engine start and another output for the power to the outside are taken out on one side of the output shaft, the seal construction can be favorably simplified. However, with this arrangement, to bear thrusts from the respective output shafts in the axial directions thereof, new countermeasures must be taken with a view to reducing the number of parts and improving structural integrity.

It is preferable that lubrication for the high speed rotation be applied to members positioned close to the motor and lubrication for the high load be applied to speed-reduced members. However, in the case of the above-described conventional technique, it is extremely difficult to form lubricating means to overcome the problems, so that the above-described conventional technique cannot be adopted immediately.

Furthermore, a known starter motor for carrying out the engine start, as shown in Japanese Patent Laid-Open No. 60-173366 for example, includes a speed reduction mechanism having planetary gears in a power transmission system extending from a motor shaft to the output shaft provided thereon with a pinion gear. In this case, locking against fall-off of the planetary gears from the pin shafts is carried out by stopper provided on the side of a sun gear.

However, the locking against fall-off by the stopper is carried out on the side of the inner periphery of an orbital motion of the planetary gears, i.e. on the side of the sun gear, whereby a scope is small in which the stopper is abutted against the side surfaces of the planetary gears to carry out the substantial locking against fall-off. Moreover, as the stopper is provided on the side of the sun gear, with which the planetary gears are in meshing engagement and the power is transmitted therebetween, the planetary gears cannot satisfactorily be locked against fall-off, thus presenting such a problem that, when a heavy load acts on the planetary gears at the time of the engine start, the planetary gears become eccentric and smooth power transmission can not be effected.

Further, when a planetary gear mechanism is used as a speed reduction section, on an output shaft from the planetary gear mechanism, there are integrally formed a large diameter flanged portion for rotatably supporting the planetary gears and a small diameter gear portion on the output side.

However, according to the conventional forming process by the cold forging, there has not been known such a process that the above-described pinion shaft provided at one end thereof with the small diameter gear portion and at the other end with the large diameter flanged portion is formed by a series of forging steps, because the gear portion cannot be effectively protected. As a result the pinion shaft is formed through a time consuming process such as cutting, thus presenting such problems that the efficiency is low, and moreover, the cost is disadvantageously high.

SUMMARY OF THE INVENTION

One object of the present invention is to provide a starter motor wherein the thrusts from both the first and second output shafts in the axial direction can be borne by a simplified construction.

Another object of the present invention is to provide a starter motor wherein locking against fall-off of the planetary gears in a reduction mechanism using the planetary gears can e reliably carried out.

A further object of the present invention is to provide a starter motor wherein a single seal construction can reliably seal between two reduction mechanisms.

A still further object of the present invention is to provide a process of forming a pinion shaft, wherein a pinion shaft used as a second output shaft can be produced inexpensively.

The starter motor according to the present invention includes a first reduction mechanism for outputting the power from a motor shaft through a first output shaft provided thereon with a pinion gear being in mesh with a ring gear on the side of an engine and a second reduction mechanism for outputting the power from the first output shaft through a second output shaft. The second output shaft is rotatably coupled onto the first output shaft and made coaxial therewith. The power to the outside can be taken out on the side of the pinion gear. A bearing of the first output shaft is engaged with a case bracket so as to be able to bear a thrust at one side in the axial direction and a bearing of the second output shaft is engaged with another case bracket so as to be able to bear a thrust at the other side in the axial direction, respectively. Further, both output shafts are associated with each other through a stop member for regulating relative displacements in the axial directions. Thus thrust in an opposite axial direction which has not been borne by each shaft, can be borne by the other respective output shaft.

According to the present invention with the above-described arrangement, the outputs for the engine start and for taking out the power to the outside can be carried out at the same side, and yet, the construction for bearing the thrusts in the axial directions can be highly simplified.

Furthermore, the starter motor according to the present invention includes a power transmission system with a reduction mechanism having a plurality of planetary gears orbitally revolving around a sun gear while rotating about their own axes between the sun gear on the inner side and a ring gear on the outer side. A stopper for locking against fall-off of the planetary gears from the pin shafts is opposed to side surfaces of the planetary gears and the stopper is formed on the side of the outer periphery of the planetary gears, being clamped between the ring gear and a case bracket.

According to the present invention, the reduction mechanism having the planetary gears is provided, and yet, locking against fall-off of the planetary gears can be carried out, with eccentricity of the planetary gears being reliably avoided.

Further, the starter motor according to the present invention includes a first reduction mechanism for outputting the power from a motor shaft through a first output shaft provided thereon with a pinion gear being in mesh with a ring gear on the side of an engine and a second reduction mechanism positioned closer to the pinion gear than the first reduction mechanism, for outputting the power from the first output shaft through a second output shaft. The second output shaft is rotatably coupled onto the first output shaft and made coaxial therewith. The power to the outside can be taken out on the pinion gear's side, and a seal portion is formed between the first output shaft and a case bracket so as to partition the first reduction mechanism from the second reduction mechanism.

According to the present invention, with this arrangement, taking out of the power for the engine start and the power to the outside can be carried out at the same side, and yet, the seal construction can be provided at a single position. Also, in a transmission system, lubrication for the high speed and lubrication for the high load can be separately and reliably performed.

Furthermore, a process of forming the pinion shaft according to the present invention features that, to form a pinion shaft provided at one end thereof with a small diameter gear portion and at the other end with a large diameter flanged portion, from a cylindrical slug, first, the gear portion and the small diameter portion are formed by forging at one end of the slug, with a stepped portion being formed therebetween. Subsequently, the remaining portion of the small diameter portion and the flanged portion having a machining thickness are integrally formed by forging, with the slug being received at the other end thereof by the aforesaid stepped portion, and thereafter, a finished product is obtained.

According to the present invention, by this forming process, the pinion shaft having the gear portion and the flanged portion is formed, and yet, the pinion shaft can be produced by forging in a large quantity and inexpensively.

BRIEF DESCRIPTION OF THE DRAWINGS

The above and other objects and features of the present invention will become more apparent when referred to the following descriptions given in conjunction with the accompanying drawings, wherein like reference numerals denote like elements, and in which.

DETAILED DESCRIPTION OF THE PREFERRED EMBODIMENTS

Figure 1:
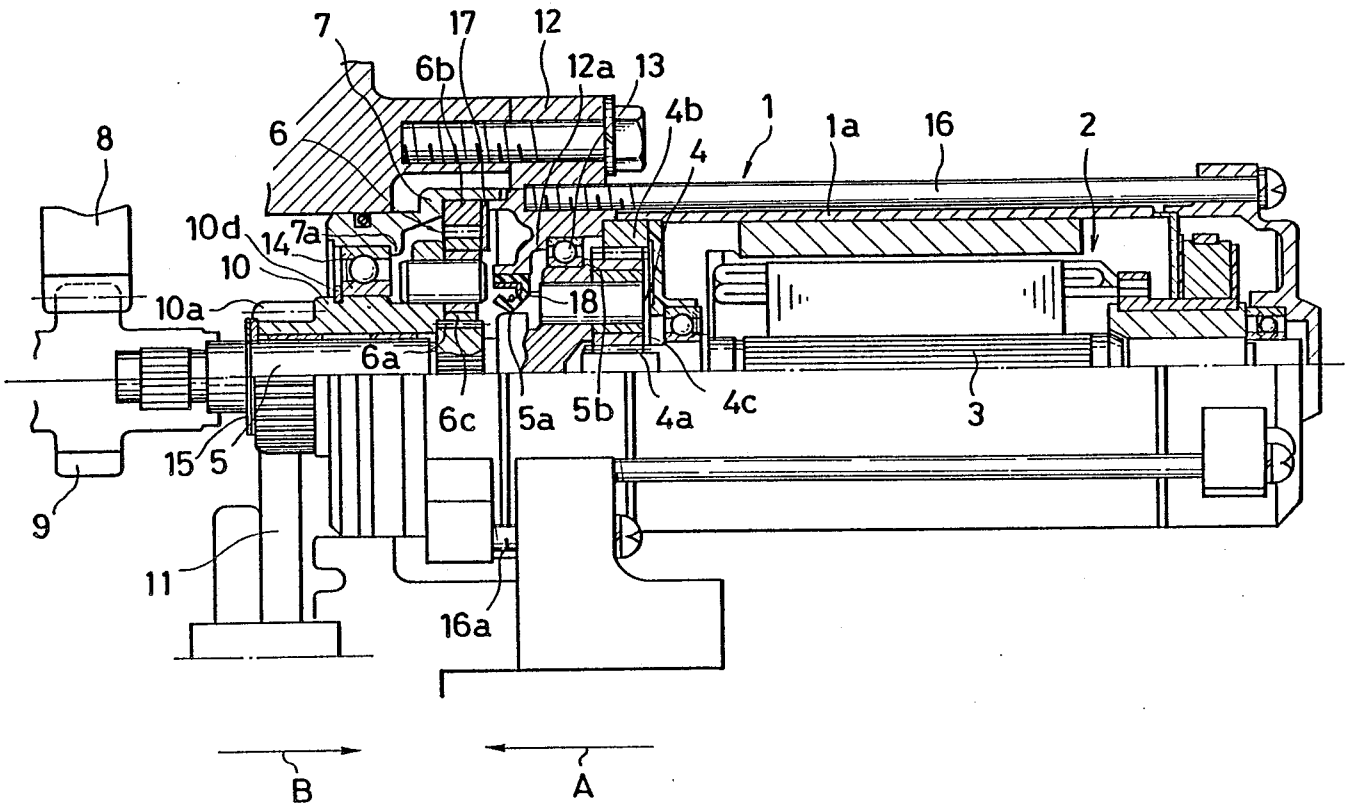
FIG. 1 a sectional view in half showing one embodiment of the starter motor according to the present invention.
Figure 2:
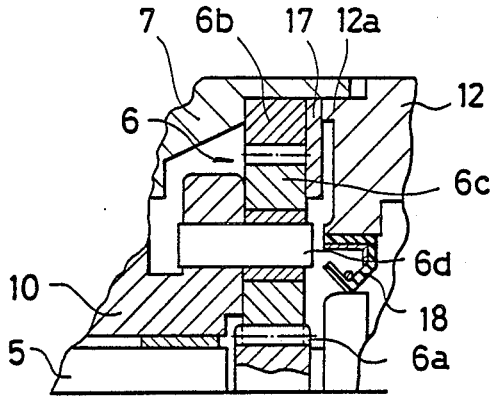
FIG. 2 is a partial sectional side view showing the reduction portion.
Figure 3:
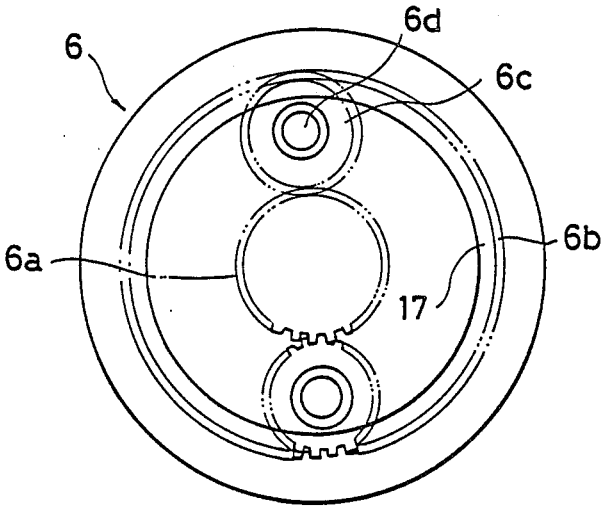
FIG. 3 is an enlarged front view thereof.
Figure 4:
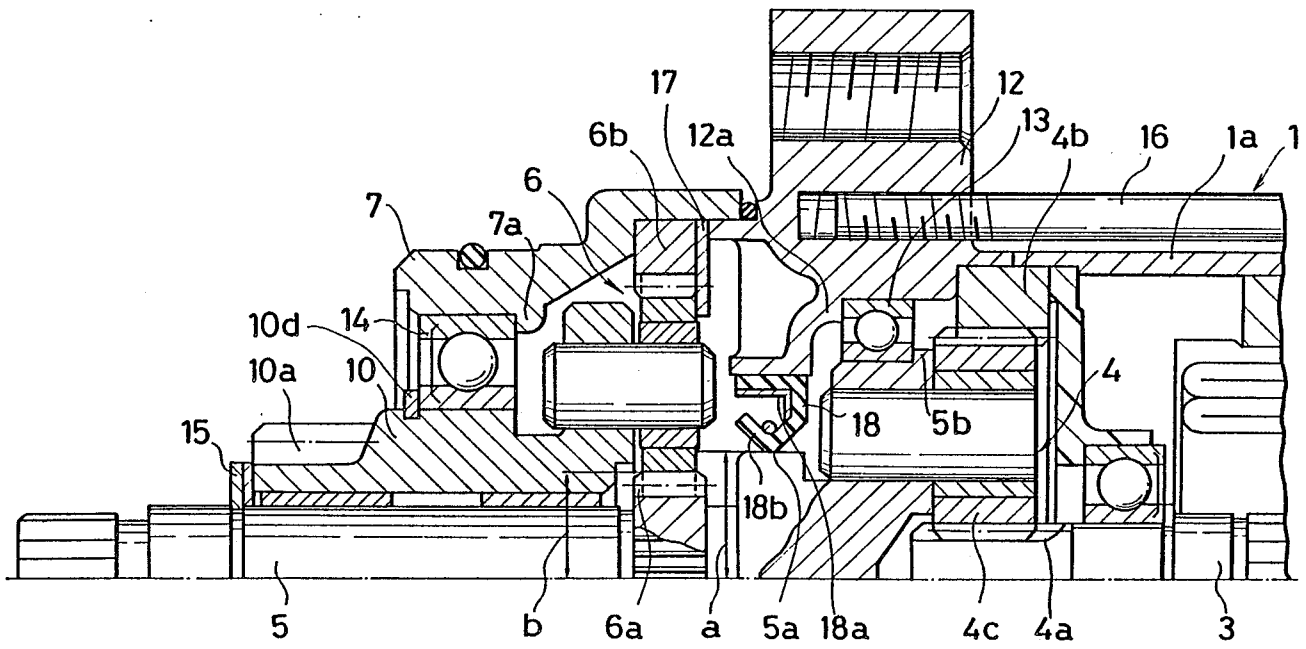
FIG. 4 is an enlarged partial sectional view showing the seal portion.

Referring to the drawings, particularly to FIG. 1, reference numeral 1 indicates a motor portion of a starter motor. Rotatably supported by a yoke 1*a* of the motor portion 1 is a motor shaft 3 forming an armature 2, and a gear 4*a* is keyed on one end of the motor shaft 3. More specifically, this gear 4*a* forms a sun gear as being an input gear of a first reduction mechanism 4 constituted by a planetary gear mechanism. The first reduction mechanism 4 includes the sun gear 4*a*, an internal gear 4*b* fixed onto the inner peripheral surface of an intermediate bracket 12 which is contiguous to the yoke 1*a* and is integrally fixed to the yoke 1*a* with through bolts 16, and a plurality of planetary gears 4*c* being in meshing engagement between both gears 4*a* and 4*b*. Moreover, the respective planetary gears 4*c* are rotatably supported on the flanged portion of the first output shaft 5, which is coaxial with the motor shaft 3. The planetary gears 4*c* orbitally revolve around the sun gear 4*a* while rotating about their own axes, whereby, when the motor rotates, the rotation thereof is transmitted to the first output shaft 5 in a reduced state. Integrally provided on the forward end portion of this first output shaft 5 is a pinion gear 9 being in mesh with the ring gear 8 on the engine side, whereby the first output shaft 5 rotates to thereby start the engine.

On the other hand, designated at 6 is a second reduction mechanism, which has the gear keyed to the first output shaft 5 as a sun gear 6*a*. The second reduction mechanism 6 includes this sun gear 6*a*, an internal gear 6*b* fixed onto the inner periphepral surface of an end bracket 7 contiguous to the intermediate bracket 12 (which is integrally fixed to the intermediate bracket through a bolt 16*a*) and a plurality of planetary gears 6*c* being in meshing engagement between both gears 6*a* and 6*b*. The respective planetary gears 6*c* orbitally revolving around the sun gear 6*a* while rotating about their own axes are rotatably supported on a flanged portion of the second output shaft 10, whereby the second reduction mechanism 6 is inputted thereinto with the power from the sun gear 6*a* which is outputted through the second output shaft 10 in a reduced state. This second output shaft 10 is rotatably coupled onto the first output shaft 5 and made coaxial therewith. Then, when the first output shaft 5 is driven and rotated by the motor as described above, rotation is passed through the second reduction mechanism 6 having the first output shaft 5 as being the input shaft thereof, whereby the second output shaft 10 is rotated in the reduced state. Integrally formed on the forward end portion of this second output shaft 10 is an output gear 10*a* which is in mesh with an input gear 11 on the side of an externally operating section such as for example a pump, so that the second output shaft 10 can take out the power to the outside on the side of the pinion gear 9.

Incidentally, in this embodiment, no one-way clutch is provided in the two power transmission systems, which extend from the motor shaft 3 to the output shafts 5 and 10. However, in this case, suitable clutch mechanisms such as one-way clutches are provided in the transmission system from the ring gear 8 to the engine and the transmission system from the input gear 11 to the externally operating section, respectively, and both systems can avoid interfering with each other at the time of the engine start and during the operation of the externally operating section.

In the starter motor having the reduction mechanisms 4 and 6 of two stages and capable of obtaining the outputs for the engine start and for taking out the power to the outside at the same side, the construction of the output shafts 5 and 10 for bearing thrusts in the axial directions are as shown below. More specifically, the first output shaft 5 is journaled on the intermediate bracket 12 through a bearing 13. The output side surface of the outer case of this bearing 13 is engaged with and supported by a stepped portion 12*a* formed on the intermediate bracket 12, so that a thrust in the direction of the output side (direction indicated by an arrow A) can be borne. On the other hand, the second output shaft 10 is rotatably supported by the end bracket 7 through a bearing 14. A counter-output side surface, contrary to the above, of the outer case of this bearing 14 is supported by a stepped portion 7*a* formed on the end bracket 7, so that a thrust in the direction opposite to the above (direction indicated by an arrow B) can be borne. Further, in the position of the output side, the first output shaft 5 and the second output shaft 10 are regulated in relative displacement in the axial directions by a stop ring 15 (corresponding to the stop member according to the present invention) coupled onto the outer periphery of the first output shaft 5. In short, a displacement of the first output shaft 5 relative to the second output shaft 10 in the direction B is regulated, whereas, a displacement of the second output shaft 10 relative to the first output shaft 5 in the direction A is regulated, respectively. As for the first output shaft 5, the thrust in the direction A is borne by the intermediate bracket 12 such that the bearing 13 is engaged with the stepped portion 12*a* and the thrust in the direction B is borne by the second output shaft 10, i.e. by the stepped portion 7*a*, with which the bearing 14 is engaged, through the stop ring 15, the second output shaft 10 and the bearing 14. Furthermore, as for the second output shaft 10, the thrust in the direction B is borne by the stepped portion 7*a*, whereas, the thrust in the direction A is borne by the first output shaft 5, i.e. by the stepped portion 12*a*, with which the bearing 13 is engaged, through the stop ring 15, the first output shaft 5 and the bearing 13. Additionally, as for the bearing 13 and 14 themselves, in order to regulate the relative displacement on the inner cases thereof, the bearing 13 is supported by a collar portion 5*b* of the first output shaft 5, and the bearing 14 is supported by a stop ring 10*d* provided on the second output shaft 10.

In this embodiment of the present invention, with the above-described arrangement, the engine start is made by turning ON a starter switch, not shown. More specifically, when the motor shaft 3 is rotated due to the turn-ON of the starter switch, the rotation is reduced in speed by the first reduction mechanism 4 and the power is outputted through the first output shaft 5. The power is passed through the pinion gear 9 provided on this first output shaft 9 and the ring gear 8 being in mesh therewith, to thereby start the engine. On the other hand, as for the operation of the externally operating section, when a switch for the externally operating section is turned ON to rotate the motor, the power is passed through a transmission system of two-stage speed reduction, including the motor shaft 3, the first reduction mechanism 4, the first output shaft 5 and the second reduction mechanism 6, and outputted through the second output shaft 10, and the externally operating section is operated through the input gear 11 being in mesh with an output gear 10*a* provided on this second output shaft 10.

As described above, according to the present invention, the starter motor is used not only for the engine start but also effectively used as the power source for the externally operating section, and yet, in that case, the second output shaft 10 as being the output shaft for the externally operating section is coupled onto the first output shaft 5 as being the output shaft for the engine start and coaxial with each other, and the powers to the outside can be taken out on the side of the pinion gear 9. Accordingly, the seal construction for the starter motor can be limited to only one position where the output shafts are protruded, so that assemblys can be considerably simplified and reliability can be greatly improved.

Moreover, the construction of both output shafts 5 and 10 to bear the thrusts in the axial directions are determined such that, as for the first output shaft 5, the thrust in the direction A is borne by the engagement of the stepped portion 12*a* of the intermediate bracket 12 with the bearing 13, and, as for the second output shaft 10, the thrust in the direction B is borne by the engagement of the stepped portion 7*a* of the end bracket 7 with the bearing 14. As for the thrusts to be borne by the respective output shafts 5 and 10 in directions opposite to the above directions A and B, both output shafts 5 and 10 are associated with each other through a stop ring 15. Thus displacements of both output shafts 5 and 10 in the axial directions can be regulated, whereby the construction to bear the thrust of the other output shaft can be mutually utilized as it is. As the result, the constructions to bear the thrusts of the output shafts 5 and 10 can be greatly simplified, so that the number of the parts can be decreased to a considerable extent, and the workability and assembling properties can be greatly improved, thus enabling the starter motors to be inexpensive, highly reliable, and mass producible.

Incidentally, it is possible to reverse the directions, in which the respective output shafts bear the thrusts on the sides of the case brackets in this embodiment.

To summarize the above, since this embodiment is of the above-described arrangement, the power from the starter motor can be effectively used not only for the engine start but also as the power source for the externally operating section. Moreover, the second output shaft for the externally operating section is coupled onto the first output shaft for the engine start to form a double shaft construction, whereby the power to the outside can be taken out on the second output shaft on the pinion gear's side. The seal construction of the output shafts and the case brackets is provided only at one portion, but not two positions at the opposite sides of the output shafts. Yet, the respective output shafts are engaged with the case bracket so that they can bear the thrust in respective opposite directions. The thrust in the direction, which is not being borne by the respective output shaft, is borne by each of the other output shafts under association with the stop member. As the result, the constructions for bearing the thrusts of both output shafts can be greatly simplified. The number of parts can be considerably reduced, the starter motor can be rendered light in weight and compact in size, and the assembling properties can be highly improved, thus enabling the starter motors to be inexpensive, high in reliability, and mass producible.

In the above embodiment having the above-described reduction mechanisms 4 and 6 of the two stages, the second reduction mechanism 6 has another characteristic feature of the present invention. More specifically, the pair of planetary gears 6c of the second reduction mechanism 6 are rotatably supported by the pin shafts 6d provided on the flanged portion of the second output shaft 10, and locking against fall-off of the planetary gears is constructed as shown below. In short, the ring gear 6b is coupled and fixed to the inner peripheral surface of the end bracket 7 on the side of the boundary surface of the intermediate bracket 12, and ring-shaped stopper 17 is further provided on the side surface of the intermediate bracket 12. Moreover, the stopper 17 are clamped at the opposite side surfaces thereof by the side surface of the ring gear 6b and the protruded portion 12a of the intermediate bracket 12, which is coupled into the end bracket 7, and held therebetween, and the side surfaces thereof are opposed to the planetary gears 6c on the outer periphery side of the loci of the orbital revolving of the planetary gears 6c to thereby lock the planetary gears 6c against fall-off from the pin shafts 6d.

Accordingly, in this embodiment, the reduction mechanism 6 having the planetary gears 6c is provided in the power transmission system of the starter motor, and yet, locking against fall-off of the planetary gears 6c can be reliably carried out by the stopper 17. More specifically, in this embodiment, locking against fall-off of the planetary gears 6c is carried out by the stopper 17 opposed to the side surfaces of the planetary gears 6c, but not by pins for locking against fall-off. The stopper 17 is provided on the outer diameter side of the loci of the orbital revolving of the planetary gears 6c to perform the locking, but not on the inner diameter side of the loci i.e. on the side of the sun gear 6a as in prior known structures. Accordingly, the substantial scope of coping with the locking against fall-off by the stopper 17 is widened in the circumferential direction of the loci of the orbital revolving of the planetary gears 6c, and moreover, since the stopper is clamped between the ring gear 6b and the intermediate bracket 12, both being stationary, the stopper 17 is assembled reliably on the stationary side and accurately positioned. As the result, the stopper 17 can accomplish reliable locking against fall-off with high accuracy without vibration, and, in addition, the planetary gears 6c can be prevented from being eccentric, thus providing smooth power transmission.

To summarize the above, since this embodiment is of the above-described arrangement, locking against fall-off of the planetary gears, which constitute the reduction mechanism, is carried out by the stopper opposed to the side surfaces of the planetary gears to thereby reduce the number of parts. The stopper 17 is clamped by the ring gear and the case bracket, both of which are on the stationary side, and carry out locking against fall-off from the side of the outer periphery. As the result, the planetary gears are positioned stably to the stationary side and subject to locking against fall-off by the stopper accurately positioned on the side of the outer periphery, which is opposite to the side of the sun gear, and yet, in the state of being widened in the circumferential direction of the loci of the orbital revolving thereof, whereby, along with the reliable locking against fall-off, the planetary gears can be reliably prevented from being eccentric. Thus the reduction mechanism having the planetary gears can carry out the smooth power transmission, the starter motors can be inexpensive and highly reliable, and mass producible.

Next, in the above-described starter motor having the reduction mechanisms 4 and 6 of the two stages, wherein the power for the engine start and the power to the outside can be taken out at the same side, the seal construction thereof is as follows. More specifically, the seal construction partitions the first reduction mechanism 4 from the second reduction mechanism 6 positioned closer to the pinion gear 9 than the first reduction mechanism 4. The seal member 18 is of an annular shape, the outer peripheral surface thereof (on this side is provided a reinforcing member 18a) is coupled into the inner peripheral surface of the flanged portion 12a of a boss provided on the intermediate bracket 12, and a lip portion 18b on the side of the inner periphery is elastically abutted against a seal contact portion 5a formed at a position associated with a seal portion of the first output shaft 5, to thereby perform sealing. Moreover, in this case, an outer diameter a of the seal contact portion 5a is larger than an outer diameter b of the sun gear 6a in the second reduction mechanism 6 ($a>b$).

As described above, in this embodiment, the starter motor can be effectively used not only for the engine start but also as the power source for the externally operating section. Moreover, in the latter case, the second output shaft 10 is coupled onto the first output shaft 5, whereby both output shafts 5 and 10 are coaxial with each other and the power to the outside can be taken out on the side of the pinion gear 9, so that the seal construction for the starter motor can be provided only at one position on the output side.

Moreover, the seal construction 18 on this output side partitions the reduction mechanism 4 from the second reduction mechanism 6. Accordingly, the starter motor is partitioned, bordering on this seal portion 18, into two groups including one group of the motor shaft 3 rotatable at high speed on the motor portion's side. The planetary gears 4c and the like and the other group of the members constituting the second reduction mechanism 6 rotatable at low speed but with high load on the output side. As a result, in the starter motor, on the motor portion's side where lubrication for the high speed rotation is required and on the output side where lubrication for the high load is required, lubricants suitable for the respective purposes can be properly used, so that the ideal lubrications for the starter motor can be carried out. Here, engine oil can be applied to the lubrication on the output side. However, the engine oil is prevented from being applied to the motor's side, and it is possible to apply a suitable lubricant such as grease to the motor's side. Moreover, the one to which the seal member 18 is abutted, is the first output shaft 5, which is reduced in speed, though primarily, so that the sliding resistance with the seal member can be reduced and the power transmitting efficiency can be improved.

Moreover, in this case, the sun gear 6a of the second reduction mechanism 6 is integrally formed on the first output shaft 5, and the seal contact portion 5a, against which the seal member 18 is abutted, is larger in diameter than the sun gear 6a, . Thus, in assembling the starter motor, when the first output shaft 5 is coupled into from the side of the seal member 18, possible damage of the seal member 18 by the sun gear 6a can be effectively avoided, so that a seal construction high in reliability can be obtained.

To summarize the above, since this embodiment is of the above-described embodiment, the power from the starter motor can be effectively used not only for the engine start but also as the power source for the externally operating section. Moreover, the power to the outside through the second output shaft can be taken out on the pinion gear's side. The seal construction between the output shafts and the case brackets can be provided only at one position on the output side. Yet, the seal portion in that case partitions the first reduction mechanism from the second reduction mechanism. As the result, in the starter motor, on the motor portion's side where lubrication for the high speed rotation is required and on the output side where lubrication for the high load is required, most lubricants suitable for the respective purposes can be properly used, so that the ideal lubrications for the starter motor can be carried out. Moreover, the member against which the seal member is abutted, is the first output shaft 5, which is reduced in speed, though primarily, by the first reduction mechanism, so that the sliding resistance with the seal member can be reduced and the power transmitting efficiency can be improved.

Figure 5A:
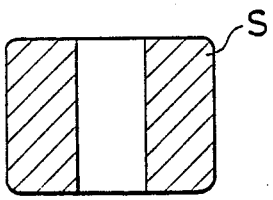
FIG. 5A to 5E are explanatory views successively showing the process of forming the second output shaft, i.e. the pinion shaft.
Figure 5B:
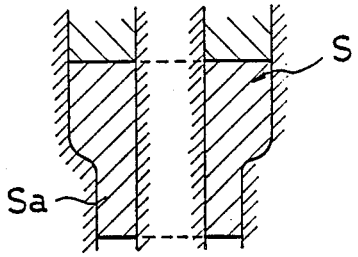
Figure 5C:
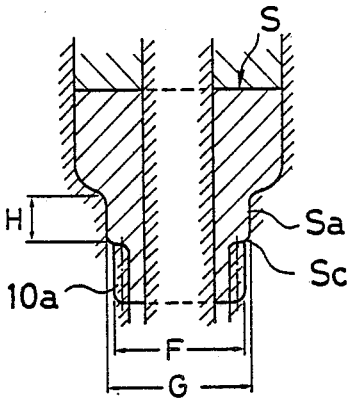

Further, this embodiment according to the present invention also features a process of forming the second output shaft 10, i.e. a pinion shaft. More specifically, in the second output shaft 10, a large diameter flanged portion 10*b*, to which the pivots of the planetary gears 6*c* are fixed, is integrally formed with the small diameter gear portion (output gear) 10*a*, and the forming steps by forging are as follows. First, a generally hollow and cylindrical slug S shown in FIG. 5A is prepared. One end portion thereof is preformed into a small diameter portion Sa, with a gear portion being included therein, by a first forward extrusion step (refer to FIG. 5B). Subsequently, the gear portion 10*a* is formed on this small diameter portion Sa by a second forward extrusion step (refer to FIG. 5C). Then, in this case, an outer diameter F of the gear portion 10*a* is set to be smaller than an outer diameter G of the small diameter portion Sa ($F<G$). A stepped portion Sc is formed on the boundary between the both portions, and the small diameter portion Sa is formed to have a length H shorter than a length J actually required ($H<J$). In this stage, the small diameter portion Sa is formed with only a portion next to the gear portion 10*a*. Additionally, the first forward extrusion step may be dispensed with. However, in this embodiment, the first forward extrusion step is provided to obtain gearing accuracy and to reduce the load during the fabrication.

Figure 5D:
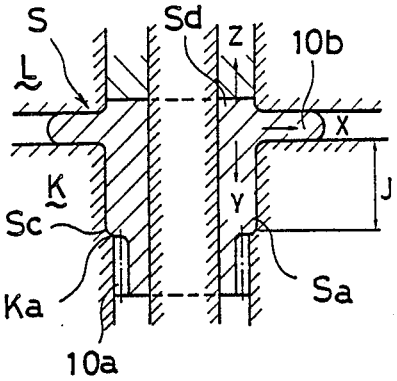
Figure 5E:
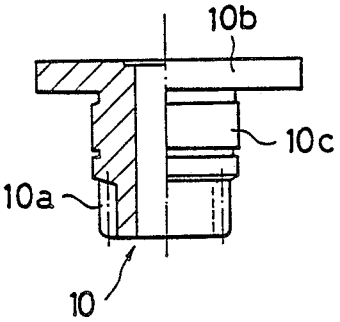

Subsequently, the flanged portion 10*b* is formed on the other end of the slug by a heading step (refer to FIG. 5D). At this time, the other end of the slug is gradually deformed by the hammer operations of a force side part L of a mold. The stepped portion Sc is engagingly received by a stepped portion Ka of a cavity side part K of the mold, whereby the gear portion 10*a* is protected. In this state, the remaining portion of the small diameter portion Sa is integrally formed with the flanged portion 10*b* having a machining thickness Sd. In this case, a material flows generally in directions indicated by arrows X, Y and Z as shown in FIG. 5D. Thus, by a series of forging steps, the gear portion 10*a*, the flanged portion 10*b* and the small diameter portion Sa are formed, passed through a finishing step such as holing, cutting, cementation and polishing. Finally, the second output shaft (pinion shaft) 10 as shown in FIG. 5E is formed. In this embodiment, this small diameter portion Sa is formed on a bearing mounted portion 10*c* of the second output shaft 10, to which is coupled the inner case of a bearing 14.

In this embodiment with the above-described arrangement, the second output shaft 10, wherein the flanged portion 10*b* for supporting the planetary gears 6*c* and the gear portion 10*a* for taking out the power to the outside are integrally formed, can be formed by a series of forging steps as described above.

Thus, in this embodiment, in providing the second output shaft 10 provided at one end portion thereof with the small diameter gear portion 10*a* and at the other end with the larger diameter flanged portion 10*b*, first, at one end of the slug S, the small diameter gear portion 10*a* and a portion of the small diameter portion Sa having the stepped portion Sc therebetween are formed by forging. Subsequently, at the other end of the slug S, the remaining portion of the small diameter portion Sa and the large diameter portion 10*b* are formed by a heading step. At this time, the load during the heading step is borne by the stepped portion Sc formed in the preceding step, whereby no excessive load is applied to the gear portion 10*a*, so that the gear portion 10*a* can be effectively protected. Accordingly, the second output shaft 10 is provided at one end thereof with the small diameter gear portion 10*a* and at the other end with the large diameter flanged portion 10*b*, and yet, forming by the series of forging steps becomes possible, so that the second output shaft 10 with high accuracy can be provided inexpensively in a mass production.

Figure 6:
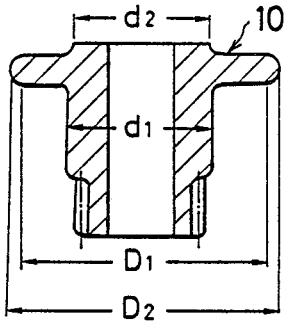
FIG. 6 is a graphic chart showing the relations of the allowable tolerance when the second output shaft, i.e. the pinion shaft is subject to cutting work.
Figure 6:
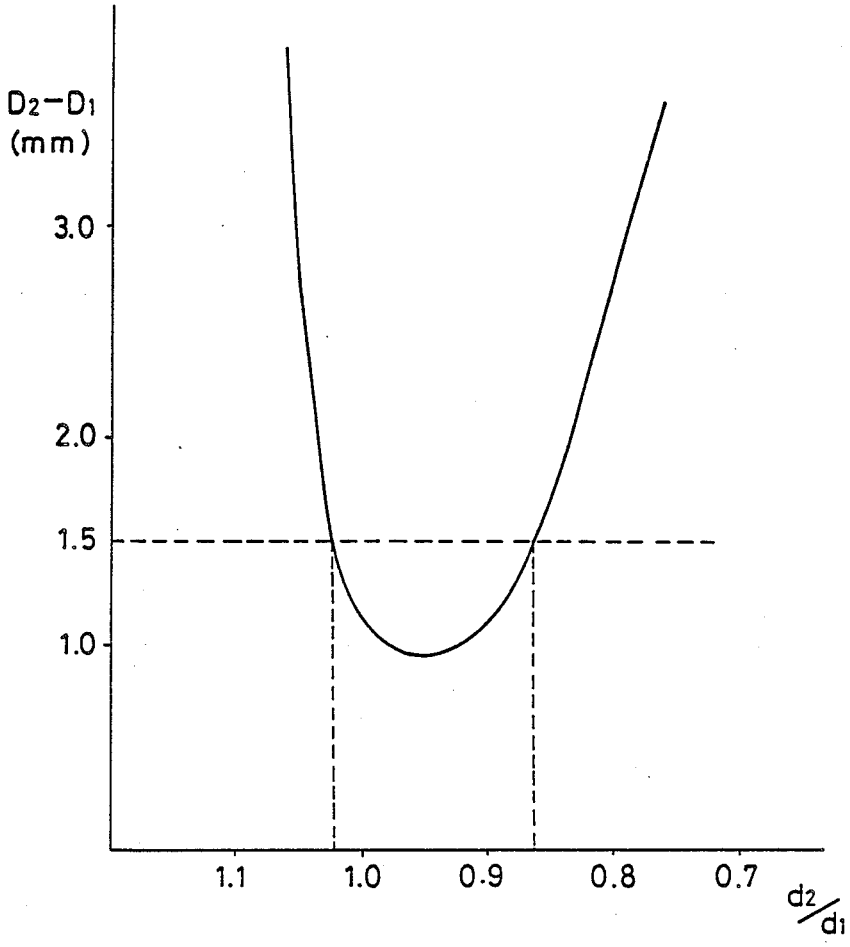

Here, at a stage where the forging steps of the flanged portion are completed, i.e. a stage shown in FIG. 5D, the flanged portion is formed in a state of no regulation in form in the lateral direction in the drawing, whereby the peripheral edge portion of the flanged portion becomes round and the flanged portion may not have an accurate circular shape. Therefore, the cutting work is applied thereto for correction. In this case, in consideration of the productivity of cutting work, as for the allowable differences in size, as shown in FIG. 6, a difference in size ($D_2-D_1$) in the flanged portion is preferably within a range of 1.5 mm. In order to obtain this, a ratio of differences in size between the small diameter portion Sa and the portion of the machining thickness ($d_2/d_1$) should be included within a range of about 0.86–1.2.

Needless to say that the present invention need not necessarily be limited to the above embodiment. In short, to form the pinion shaft provided at one end thereof with the small diameter gear portion and at the other end with the large diameter flanged portion, from the cylindrical slug, it is only necessary to adopt such a process that, first, at one end of the slug, the small diameter gear portion and a portion of the small diameter portion having the stepped portion therebetween are formed by forging, subsequently, at the other end of the slug, the remaining portion of the small diameter portion and the flanged portion having the machining thickness, with the slug being receivable by the aforesaid stepped portion, are formed by forging. Thereafter finishing work is carried out to form the starter motor. Accordingly, the slug need not necessarily be of a hollow shape, and the present invention may be applied, as it is, to the starter motor not having the reduction mechanisms of the two stages.

To summarize the above, the above embodiment is of the above-described arrangement, whereby the pinion shaft is provided at end thereof with the small diameter gear portion and at the other end with the large diameter flanged portion, and yet, the load at the time of forming the flanged portion can be borne by the stepped portion formed between the previously forged gear portion and small diameter portion. Thus the pinion shaft can be formed by a series of forming steps in the state of reliably protecting the gear portion, thus permitting provision of the pinion shafts having the small diameter gear portion and the large diameter flanged portion, with high finishing accuracy, inexpensively and in large quantities.

Furthermore, the present invention is not necessarily be limited to the above embodiment, and, needless to say that various modifications can be achieved without departing from the gist of the present invention.

What is claimed is:

1. A starter motor comprising:

a motor shaft, a first output shaft having a pinion gear provided thereon to engage a ring gear of an engine, the pinion gear being located on a side of the motor defined as a first side, a first reduction mechanism for outputting power from said motor shaft through said first output shaft, a second output shaft, a second reduction mechanism for outputting power from said first output shaft through said second output shaft, wherein said second output shaft is rotatably coupled onto said first output shaft and made coaxial therewith such that power can be taken out on the first side of said motor shaft at said pinion gear, said first output shaft having a first bearing, a first case bracket having one side, said first case bracket being engaged with said first bearing so as to be able to bear a thrust at the one side of the first case bracket in a first axial direction, said second output shaft having a second case bracket having an other side, said second case bracket being engaged with said second bearing so as to be able to bear a thrust at the other side of the second case bracket in a second axial direction opposite said first axial direction, a stop member cooperable with said first and second output shafts for controlling relative displacements of the first and second output shafts in the first and second axial directions so that a thrust in the second axial direction on the first output shaft and a thrust in the first axial direction on said second output shaft can be borne by each of said first and second output shafts.

2. The starter motor as set forth in claim 1 wherein said first case bracket is an intermediate bracket having a stepped portion and the first bearing of the first output shaft is engaged with the stepped portion of the intermediate bracket and wherein said second case bracket is an end bracket having a stepped portion and the second bearing of said second output shaft is engaged with the stepped portion of said end bracket.

3. The starter motor as set forth in claim 2 wherein the first output shaft includes a collar portion and the first bearing of the first output shaft is supported by the collar portion and wherein a stop ring is coupled to the second output shaft, the second bearing of the second output shaft being supported by the stop ring whereby relative movements of the first and second bearings toward each other are controlled.

4. The starter motor as set forth in claim 1 wherein said first output shaft has an outer end with an outer periphery and said stop member is formed with a stop ring coupled onto the outer periphery of the outer end of said first shaft.

5. The starter motor as set forth in claim 1 wherein said second reduction mechanism includes a plurality of planetary gears having side surfaces and an outer periphery, said planetary gears being supported on respective pin shafts having corresponding rotational axes, a sun gear at an inner portion of said second reduction mechanism, and a ring gear at an outer portion of said second reduction mechanism, said planetary gears orbitally revolving around the sun gear while respectively rotating about said corresponding rotational axes between said sun gear at the inner side and the ring gear at the outer side, a stopper for locking against fall off of said planetary gears from said pin shafts, said stopper engaging the side surfaces of said planetary gears, said stopper being at the outer periphery of said planetary gears and being clamped between said ring gear and said second case bracket.

6. The starter motor as set forth in claim 1 wherein a seal means is formed between said first output shaft and said first case bracket so as to partition said first reduction mechanism from said second reduction mechanism.

7. The starter motor as set forth in claim 6 wherein said first output shaft has a seal contact portion and said seal means is of annular form including an outer peripheral surface and an inner peripheral surface with a lip portion, and the first case bracket is an intermediate bracket having a flanged portion, the outer peripheral surface of said seal means engaging the inner peripheral surface of the flanged portion of the intermediate bracket, and the lip portion on the inner periphery of said seal means is elastically abutted against the seal contact portion of said first output shaft.

* * * * *

UNITED STATES PATENT AND TRADEMARK OFFICE

CERTIFICATE OF CORRECTION

PATENT NO. : 4,896,551

DATED : January 30, 1990

INVENTOR(S) : Hideyuki Minami et al.

It is certified that error appears in the above-identified patent and that said Letters Patent is hereby corrected as shown below:

At column 3, line 62, after "reduction" insert --mechanism--.

At column 11, line 4, change "forged" to --formed--.

Signed and Sealed this

First Day of February, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,896,551

DATED : January 30, 1990

INVENTOR(S) : Hideyuki Minami, et. al.

It is certified that error appears in the above-indentified patent and that said Letters Patent is hereby corrected as shown below:

On the Title page, item [73], Assignee: should read--"Mitsuba Electric Manufacturing Co., Ltd., Gunma, Japan; and Honda Giken Kogyo Kabushiki Kaisha, Tokyo, Japan--.

Signed and Sealed this

Twenty-sixth Day of April, 1994

*Attest:*

Bruce Lehman

BRUCE LEHMAN

*Attesting Officer*

*Commissioner of Patents and Trademarks*